US008766175B2

(12) United States Patent
Satoh

(10) Patent No.: US 8,766,175 B2
(45) Date of Patent: Jul. 1, 2014

(54) TANDEM TIME-OF-FLIGHT MASS SPECTROMETER AND METHOD OF MASS SPECTROMETRY USING THE SAME

(71) Applicant: JEOL Ltd., Tokyo (JP)

(72) Inventor: Takaya Satoh, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 13/894,607

(22) Filed: May 15, 2013

(65) Prior Publication Data

US 2013/0306859 A1 Nov. 21, 2013

(30) Foreign Application Priority Data

May 15, 2012 (JP) ..... 2012-111118

(51) Int. Cl.
*H01J 49/00* (2006.01)
*H01J 49/40* (2006.01)

(52) U.S. Cl.
CPC ..... *H01J 49/004* (2013.01); *H01J 49/005* (2013.01); *H01J 49/0031* (2013.01); *H01J 49/0045* (2013.01)
USPC ..... 250/283; 250/281; 250/282; 250/287

(58) Field of Classification Search
CPC ..... H01J 49/0027; H01J 49/0031; H01J 49/0045; H01J 49/005
USPC ..... 250/281, 282, 283, 287
See application file for complete search history.

(56) References Cited

U.S. PATENT DOCUMENTS

| | | | | |
|---|---|---|---|---|
| 5,233,189 | A * | 8/1993 | Wollnik | 250/287 |
| 6,770,871 | B1 * | 8/2004 | Wang et al. | 250/281 |
| 7,385,187 | B2 * | 6/2008 | Verentchikov et al. | 250/287 |
| 7,504,620 | B2 * | 3/2009 | Sato et al. | 250/287 |
| 7,667,195 | B2 * | 2/2010 | Vestal | 250/287 |
| 8,093,555 | B2 * | 1/2012 | Yamaguchi | 250/287 |
| 2007/0187585 | A1 * | 8/2007 | Verentchikov | 250/287 |
| 2007/0228270 | A1 * | 10/2007 | Yamaguchi | 250/287 |
| 2008/0067351 | A1 * | 3/2008 | Satoh et al. | 250/287 |
| 2008/0272291 | A1 * | 11/2008 | Vestal | 250/287 |
| 2009/0026365 | A1 * | 1/2009 | Satoh | 250/287 |
| 2009/0212208 | A1 * | 8/2009 | Sato et al. | 250/282 |

(Continued)

FOREIGN PATENT DOCUMENTS

| | | | |
|---|---|---|---|
| GB | 2080021 | A | 1/1982 |
| JP | 2000243345 | A | 9/2000 |

(Continued)

OTHER PUBLICATIONS

M. Toyoda et al., "Multi-turn time-of-flight mass spectrometers with electrostatic sectors", Journal of Mass Spectrometry, 2003, pp. 1125-1142, vol. 38.

*Primary Examiner* — Michael Logie
(74) *Attorney, Agent, or Firm* — The Webb Law Firm

(57) ABSTRACT

A tandem time-of-flight mass spectrometer is offered which can perform MS/MS measurements efficiently without sample wastage by ingeniously combining flight time ranges required by precursor ions with measurement times actually taken to measure the precursor ions. The mass spectrometer has an array input means for causing the flight time ranges required by selected precursor ions and the actually taken measurement times in which the precursor ions are measured to be appropriately arrayed in a time-sequential manner such that the flight time ranges and measurement times do not overlap each other.

4 Claims, 5 Drawing Sheets

(56) References Cited

U.S. PATENT DOCUMENTS

| | | | | |
|---|---|---|---|---|
| 2010/0301202 | A1* | 12/2010 | Vestal | 250/282 |
| 2011/0133073 | A1* | 6/2011 | Sato et al. | 250/282 |
| 2011/0220786 | A1* | 9/2011 | Satoh | 250/287 |
| 2012/0068062 | A1* | 3/2012 | Satoh | 250/282 |
| 2012/0085905 | A1* | 4/2012 | Satoh | 250/287 |
| 2012/0168618 | A1* | 7/2012 | Vestal | 250/282 |

FOREIGN PATENT DOCUMENTS

| | | | |
|---|---|---|---|
| JP | 200386129 | A | 3/2003 |
| JP | 200612782 | A | 1/2006 |
| WO | 2005001878 | A2 | 1/2005 |

* cited by examiner

| MASSES OF PRECURSOR IONS HAVING BEEN SELECTED FIRST | MASSES OF PRECURSOR IONS WHICH CAN BE SELECTED NEXT | | | |
|---|---|---|---|---|
| | RELATIVE VALUE OF FLIGHT TIME OF FIRST TOFMS AGAINST THAT OF SECOND TOFMS | | | |
| | 10 | 5 | 2 | 0.5 |
| 200 | 242 | 288 | 450 | 800 |
| 400 | 484 | 576 | 900 | 1600 |
| 600 | 726 | 864 | 1350 | 2400 |
| 800 | 968 | 1152 | 1800 | 3200 |
| 1000 | 1210 | 1440 | 2250 | 4000 |
| 1200 | 1452 | 1728 | 2700 | 4800 |
| 1400 | 1694 | 2016 | 3150 | 5600 |
| 1600 | 1936 | 2304 | 3600 | 6400 |
| 1800 | 2178 | 2592 | 4050 | 7200 |
| 2000 | 2420 | 2880 | 4500 | 8000 |
| 2200 | 2662 | 3168 | 4950 | 8800 |

*FIG. 6*

PRIOR ART

FLIGHT TIME OF PRECURSOR IONS TO REACH THE ION GATE
$T_{1,IG}$
$T_{2,IG}$
$T_{3,IG}$
$T_{4,IG}$
$T_{5,IG}$
$T_{6,IG}$
$T_{7,IG}$
FLIGHT TIME

FLIGHT TIME OF NON-FRAGMENTED PRE4 AND THAT OF THE PRODUCT IONS GENERATED FROM PRE4
$T_{4,D}$ : DETECTION TIME OF PRE4 WHICH WAS NOT FRAGMENTED
FLIGHT TIME RANGE WHICH THE PRODUCT IONS GENERATED FROM PRE4 ARE OBSERVED
FLIGHT TIME

TANDEM TIME-OF-FLIGHT MASS SPECTROMETER AND METHOD OF MASS SPECTROMETRY USING THE SAME

BACKGROUND OF THE INVENTION

1. Field of the Invention

The present invention relates to a tandem time-of-flight mass spectrometer used in quantitative analysis and simultaneous qualitative analysis of trace compounds and also in structural analysis of sample ions. The invention also relates to a method of mass spectrometry using this tandem-of-flight mass spectrometer.

2. Description of Related Art

[Time-of-Flight Mass Spectrometer (TOFMS)]

A time-of-flight (TOF) mass spectrometer is an instrument that finds the mass-to-charge ratio (m/z) of each ion by accelerating ions with a given accelerating voltage, causing them to fly, and calculating the m/z from the time taken for each ion to reach a detector. In TOFMS, ions are accelerated by a given pulsed voltage $V_a$. At this time, the velocity of the ion, v, is found from the law of conservation of energy and given by $$\frac{mv^2}{2} = qeV_a \tag{1}$$

$$v = \sqrt{\frac{2qeV_a}{m}} \tag{2}$$

where m is the mass of the ion, q is the electric charge of the ion, and e is the elementary charge.

Therefore, the flight time T required for the ion to reach a detector, placed behind at a given distance of L, is given by $$T = \frac{L}{v} = L\sqrt{\frac{m}{2qeV_a}} \tag{3}$$

As can be seen from Eq. (3), TOFMS is an instrument that separates masses by employing the fact that the flight time T differs according to the mass m of each ion. One example of the linear TOFMS is shown in FIG. 1. Reflectron TOFMS that permits improvement of the energy convergence and elongation of flight time by placing a reflectron field between an ion source and a detector has enjoyed wide acceptance. One example of the reflectron TOFMS is shown in FIG. 2.

[Improvement of Performance of TOFMS]

The mass resolution of a TOF mass spectrometer is defined as follows:

$$\text{mass resolution} = \frac{T}{2\Delta T} \tag{4}$$

where T is the total flight time and ΔT is a peak width.

That is, if the peak width ΔT is made constant and the total flight time T can be lengthened, the mass resolution can be improved. However, in the related art linear or reflectron type TOFMS, increasing the total flight time T (i.e., increasing the total flight distance) will lead directly to an increase in instrumental size. A multi-pass time-of-flight mass spectrometer has been developed to realize high mass resolution while avoiding an increase in instrumental size (see M. Toyoda, D. Okumura, M Ishihara and I. Katakuse, *J. Mass Spectrom.*, 2003, 38, pp. 1125-1142). This instrument uses four toroidal electric fields each consisting of a combination of a cylindrical electric field and a Matsuda plate. The total flight time T can be lengthened by accomplishing multiple turns in an 8-shaped circulating orbit. In this apparatus, the spatial and temporal spread at the detection surface has been successfully converged up to the first-order term using the initial position, initial angle, and initial kinetic energy.

However, the TOFMS in which ions revolve many times in a closed trajectory suffers from the problem of overtaking. That is, because ions revolve multiple times in a closed trajectory, lighter ions moving at higher speeds overtake heavier ions moving at smaller speeds. Consequently, the fundamental concept of TOFMS that ions arrive at the detection surface in turn first from the lightest one does not hold.

The spiral-trajectory TOFMS has been devised to solve this problem. The spiral-trajectory TOFMS is characterized in that the starting and ending points of a closed trajectory are shifted from the closed trajectory plane in the vertical direction. To achieve this, in one method, ions are made to impinge obliquely from the beginning (see JP-A-2000-243345). In another method, the starting and ending points of the closed trajectory are shifted in the vertical direction using a deflector (see JP-A-2003-86129). In a further method, laminated toroidal electric fields are used (see JP-A-2006-12782).

Another TOFMS has been devised which is based on a similar concept but in which the trajectory of the multi-pass TOF-MS (see GB2080021) where overtaking occurs is zigzagged (see WO2005/001878 pamphlet).

[MS/MS Measurements and TOF/TOF Instrumentation]

In mass spectrometry, ions generated by an ion source are separated according to m/z value by a mass analyzer and detected. The results are represented in form of a mass spectrum in which m/z values and relative intensities of ions are graphed. This measurement is hereinafter referred to as an MS measurement, in contrast with MS/MS measurements. In an MS/MS measurement (see FIG. 3), certain ions generated by an ion source are selected as precursor ions by a first stage of mass spectrometer (MS1), are made to fragment spontaneously or forcibly to thereby produce product ions, and the product ions are mass analyzed by a second stage of mass spectrometer (MS2). An instrument enabling an MS/MS measurement is referred to as an MS/MS instrument (see FIG. 4). In the MS/MS measurement shown in FIG. 3, the m/z values of the precursor ions, the m/z values of the product ions generated in plural fragmentation paths, and their relative intensity information are obtained and, therefore, it is possible to perform structural analysis of the precursor ions.

MS/MS equipment where two TOFMS instruments are connected in series is generally known as a tandem TOF (or TOF/TOF) instrument. This is mainly used in a system using a MALDI ion source. Many conventional, tandem TOF spectrometers are composed of a linear TOFMS and a reflectron TOFMS (see FIG. 5). An ion gate is placed between the two TOFMS instruments to select precursor ions. The focal point of the first TOFMS instrument is placed near the ion gate. In some cases, precursor ions fragment spontaneously. In other cases, precursor ions are forced to fragment in a collision cell placed ahead of a reflectron field produced either by the first TOFMS instrument or the second TOFMS instrument.

A method of selecting plural precursor ions in a single flight time measurement (see WO2005/001878 pamphlet) that is especially associated with the present invention is described. Where the second TOFMS instrument has a longer flight time than the first TOFMS instrument as encountered where the first and second TOFMS instruments are made of a linear TOFMS and a reflectron TOFMS, respectively, it is only possible to perform an MS/MS measurement where only one precursor ion is selected for measurement using a single flight time.

At this time, it follows that ions, other than the selected precursor ions, waste the sample. However, where the first TOFMS instrument provides a sufficiently longer flight time than the second TOFMS instrument, plural precursor ions can be selected in a measurement using a single flight time. Where the value obtained by dividing the flight time through the first TOFMS by the flight time through the second TOFMS is 0.5, 2, 5, and 10, respectively, the relationship between the mass of the initially selected precursor ions and the mass of precursor ions that can be selected next is illustrated in the table of FIG. 6.

As is obvious from FIG. 6, as the difference of the flight time through the first TOFMS instrument with the flight time through the second TOFMS instrument increases, more precursor ions can be selected during a measurement using a single flight time. It is seen that the utilization efficiency of the sample is enhanced greatly compared with the case where only one precursor ion can be selected.

One method of elongating the flight time through the first TOFMS instrument is to set the accelerating voltage for the first TOFMS instrument much smaller than the accelerating voltage for the second TOFMS instrument. Another method is to adopt a TOFMS instrument having a long flight time as the first TOFMS instrument. In either method, however, the transmittance of precursor ions through the first TOFMS instrument deteriorates because of an increase in the flight time. If the first TOFMS instrument is made too long, the attenuation of ion amount passed through the first TOFMS relative to the ion amount of precursor ions generated in the ion source can no longer be neglected.

One problem with the related art tandem TOF mass spectrometry is that, in a case where the flight time through the first TOFMS instrument is shorter than the flight time through the second TOFMS instrument, only one precursor ion can be selected during a measurement using a single flight time. This leads to sample wastage. In a case where the flight time through the first TOFMS instrument is sufficiently greater than (e.g., more than 10 times) the flight time through the second TOFMS instrument, plural precursor ions can be selected during a measurement of a single flight time but the transmittance of the ions through the first TOFMS instrument deteriorates. This also leads to a decrease in the sample utilization efficiency.

SUMMARY OF THE INVENTION

In view of the above-described problems, it is an object of the present invention to provide a mass spectrometer which has first and second TOF mass analyzers and which suppresses decreases in the ion amount in the first TOF mass analyzer by assuming a case where the flight time through the first TOF mass analyzer is several times greater than the flight time through the second TOF mass analyzer. In this configuration, restrictions are imposed on the number of precursor ions that can be selected during a measurement using a single flight time. Therefore, the present invention offers a technique for selecting precursor ions ingeniously.

In cases where plural precursor ions are selected in a measurement using a single flight time, the number of accumulations necessary to obtain a product ion spectrum of sufficiently high quality may often differ depending on the amount of precursor ions or on the quality of the obtained product ion spectrum. The invention also offers a method of producing product ion spectra efficiently even in such cases.

The above-described object is achieved in accordance with the present invention by a method of mass spectrometry using a tandem time-of-flight mass spectrometer which has an ion source for ionizing a sample and ejecting the produced ions in a pulsed manner and repetitively, a first TOF mass analyzer for causing the ejected sample ions to travel and for mass analyzing the ions, an ion gate disposed in a path through which precursor ions separated according to mass-to-charge ratio by the first TOF mass analyzer travel, a collisional cell into which the precursor ions passed through the ion gate are introduced for fragmenting the ions to thereby produce product ions, a second TOF mass analyzer for causing the product ions emerging from the collisional cell to travel and for separating the ions according to mass-to-charge ratio, and a detector for detecting the product ions separated by the second TOF mass analyzer. The method of mass spectrometry starts with setting a given flight time T1 through the first TOF mass analyzer twice or more greater than a given flight time T2 through the second TOF mass analyzer. The ion gate is opened plural times at different timings while a single mass analysis is being performed in the first TOF mass analyzer in the given flight time T1. Thus, plural species of precursor ions are introduced in succession into the second TOF mass analyzer via the collisional cell. Then, the resulting product ions are mass analyzed.

In one feature of this method of mass spectrometry, the ion gate is opened plural times at different timings whenever plural mass analyses are performed, each in the given flight time T1, in the first TOF mass analyzer. Thus, all the precursor ions separated according to mass-to-charge ratio in the first TOF mass analyzer are introduced into the second TOF mass analyzer via the collisional cell, and the resulting product ions are mass analyzed.

In another feature of this method of mass spectrometry, the flight time T1 is set 3 times to 10 times greater than the flight time T2.

The present invention also provides a tandem time-of-flight mass spectrometer having an ion source for ionizing a sample and ejecting the produced ions in a pulsed manner and repetitively, a first TOF mass analyzer for causing the ejected sample ions to travel and for mass analyzing the ions, a first detector for detecting precursor ions separated according to mass-to-charge ratio in the first TOF mass analyzer, an ion gate disposed in a path through which the precursor ions separated according to mass-to-charge ratio by the first TOF mass analyzer travel, a collisional cell into which the precursor ions passed through the ion gate are introduced for fragmenting the ions to thereby produce product ions, a second TOF mass analyzer for causing the product ions emerging from the collisional cell to travel and for separating the ions according to mass-to-charge ratio, a second detector for detecting the ions separated by the second TOF mass analyzer, and a gate signal generator for generating a gate signal to open the ion gate after a delay since ejection of sample ions from the ion source such that desired ion species pass through the gate. The given flight time T1 through the first TOF mass analyzer is set twice or more greater than the given flight time T2 through the second TOF mass analyzer. The gate signal generator has schedule creation means for creating a schedule of timings at which the gate signal for selectively passing the precursor ions through the ion gate is generated such that when the precursor ions appearing in a mass spectrum based on mass spectral data about precursor ions previously obtained using the first detector are selectively passed through the ion gate, flight time ranges in which the product ions are detected by the second detector do not overlap each other. The gate signal generator generates the gate signal based on the schedule created by the schedule creation means and supplies the generated gate signal to the ion gate.

In one feature of this tandem time-of-flight mass spectrometer, the schedule creation means creates the schedule of timings at which the gate signal is generated for plural mass analyses to permit the second TOF mass analyzer to mass analyze product ions regarding all the precursor ions owing to plural mass analyses made by the first TOF mass analyzer in a case where the second TOF mass analyzer cannot mass analyze product ions regarding all the precursor ions appearing in the mass spectrum of precursor ions while a single mass analysis is being made by the first TOF mass analyzer.

In another feature of this tandem time-of-flight mass spectrometer, the gate signal generator holds information indicating a relationship between mass-to-charge ratios of the precursor ions selected by the ion gate and mass-to-charge ratios of precursor ions capable of being selected next. Regarding precursor ions appearing in a precursor ion mass spectrum based on the information, the schedule creation means creates the schedule of timings at which the gate signal is generated to selectively pass the precursor ions such that flight time ranges in which the product ions are detected by the second detector do not overlap each other when the precursor ions are selectively passed through the ion gate.

In a further feature of this tandem time-of-flight mass spectrometer, the flight time T1 is set 3 times to 10 times greater than the flight time T2.

A method of mass spectrometry according to the present invention is implemented by a tandem time-of-flight mass spectrometer which has an ion source for ionizing a sample and ejecting the produced ions in a pulsed manner and repetitively, a first TOF mass analyzer for causing the ejected sample ions to travel and for mass analyzing the ions, an ion gate disposed in a path through which the precursor ions separated according to mass-to-charge ratio by the first TOF mass analyzer travel, a collisional cell into which the precursor ions passed through the ion gate are introduced for fragmenting the ions to thereby produce product ions, a second TOF mass analyzer for causing the product ions emerging from the collisional cell to travel and for separating the ions according to mass-to-charge ratio, and a detector for detecting the product ions separated by the second TOF mass analyzer. The method of mass spectrometry starts with setting a given flight time T1 through the first TOF mass analyzer twice or more greater than a given flight time T2 through the second TOF mass analyzer. The ion gate is opened plural times at different timings while a single mass analysis is being performed in the first TOF mass analyzer in the given flight time T1. Thus, plural species of precursor ions are introduced in succession into the second mass analyzer via the collisional cell. Then, the resulting product ions are mass analyzed. MS/MS measurements can be performed efficiently without wasting the sample by ingeniously combining flight time ranges required for different precursor ions and actually taken measurement times.

The present invention also provides a tandem time-of-flight mass spectrometer having an ion source for ionizing a sample and ejecting the produced ions in a pulsed manner and repetitively, a first TOF mass analyzer for causing the ejected sample ions to travel and for mass analyzing the ions, a first detector for detecting the precursor ions separated according to mass-to-charge ratio in the first TOF mass analyzer, an ion gate disposed in a path through which the precursor ions separated according to mass-to-charge ratio by the first TOF mass analyzer travel, a collisional cell into which the precursor ions passed through the ion gate are introduced for fragmenting the ions to thereby produce product ions, a second TOF mass analyzer for causing the product ions emerging from the collisional cell to travel and for separating the ions according to mass-to-charge ratio, a second detector for detecting the ions separated by the second TOF mass analyzer, and a gate signal generator for generating a gate signal to open the ion gate after a delay since ejection of sample ions from the ion source such that desired ion species pass through the gate. The given flight time T1 through the first TOF mass analyzer is set twice or more greater than the given flight time T2 through the second TOF mass analyzer. The gate signal generator has schedule creation means for creating a schedule of timings at which the gate signal for selectively passing the precursor ions through the ion gate is generated such that when the precursor ions appearing in a mass spectrum based on mass spectral data about precursor ions previously obtained using the first detector are selectively passed through the ion gate, flight time ranges in which the product ions are detected by the second detector do not overlap each other. The gate signal generator generates the gate signal based on the schedule created by the schedule creation means and supplies the generated gate signal to the ion gate. MS/MS measurements can be performed efficiently without wasting the sample by ingeniously combining flight time ranges required for different precursor ions and actually taken measurement times.

BRIEF DESCRIPTION OF THE DRAWINGS

FIG. 6 is a table illustrating relationships between the flight times of precursor ions and masses.

DESCRIPTION OF THE INVENTION

The preferred embodiments of the present invention are hereinafter described with reference with the drawings.

Embodiment 1

Figure 1:
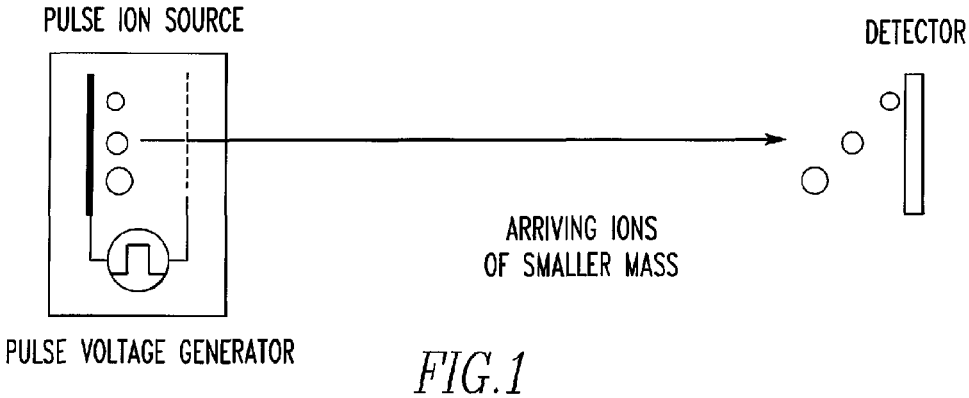
FIG.1 PRIOR ART
FIG. 1 is a schematic diagram of a conventional TOF mass spectrometer.
Figure 2:
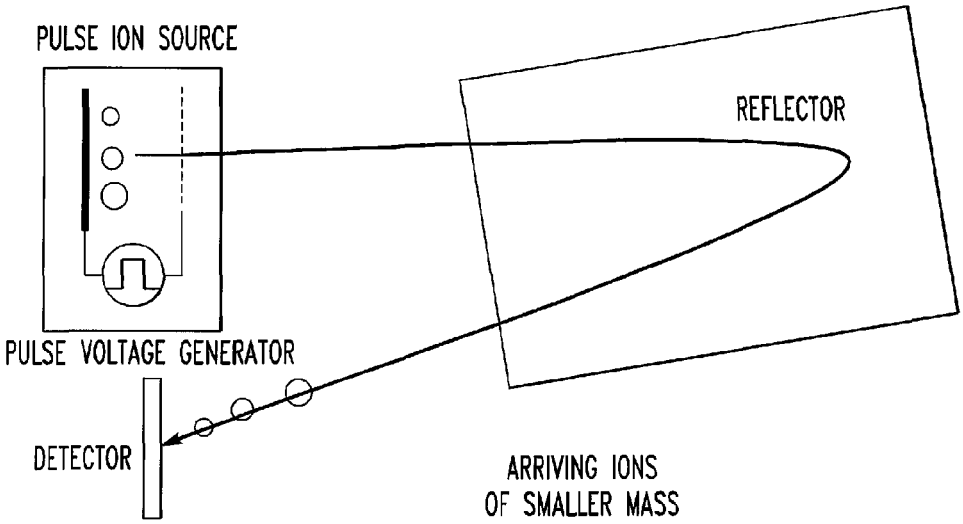
FIG.2 PRIOR ART
FIG. 2 is a schematic diagram of another conventional TOF mass spectrometer.
Figure 3:
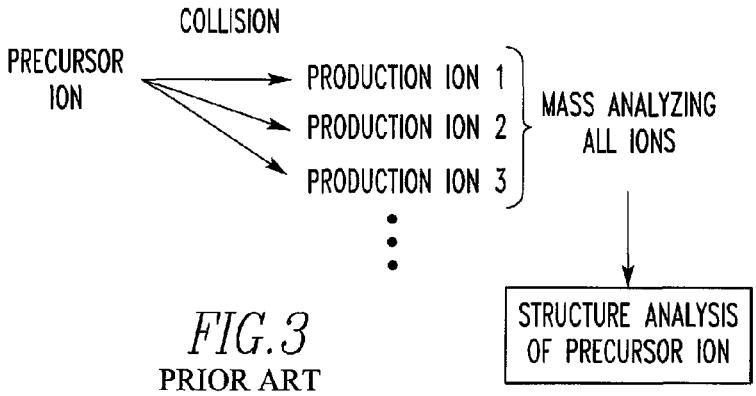
FIG.3 PRIOR ART
FIG. 3 illustrates one example of MS/MS measurement.
Figure 4:
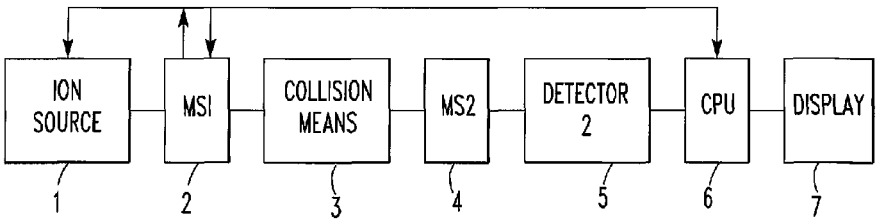
FIG. 4 PRIOR ART
FIG. 4 is a block diagram of a tandem TOF mass spectrometer, showing its fundamental configuration.
Figure 5:
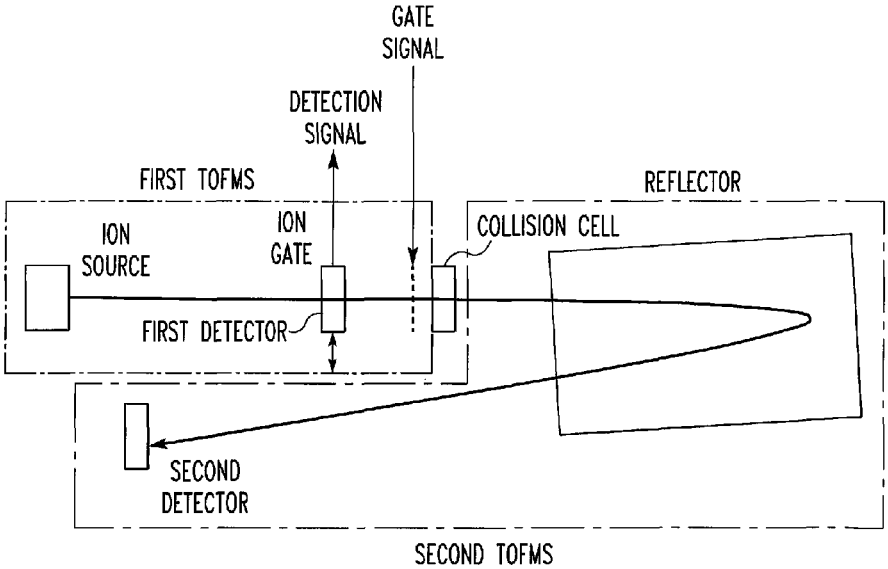
FIG. 5 PRIOR ART
FIG. 5 is a schematic representation of a tandem TOF mass spectrometer.

A tandem TOF mass spectrometer according to the present embodiment is exactly identical in fundamental structure with the instrument shown in FIG. 4. That is, sample ions generated by the ion source 1 are mass separated by the first TOF mass analyzer 2. Then, only a desired precursor peak is selected by turning on and off the ion gate (not shown) mounted either in the ion orbit of the first TOF mass analyzer 2 or near the exit of the ion orbit. The selected ions are introduced into a fragmentation means 3 such as a collisional cell placed behind the ion gate, thus fragmenting the precursor ions.

The fragmented precursor ions are further mass separated by a second TOF mass analyzer 4 and converted into an electrical signal by a second detector 5 made of a microchannel plate (MCP) mounted in the following stage. The resulting ion-induced electrical signal is converted into a digital signal by a digitizer (not shown) and sent to a CPU 6, where information is processed. The results are displayed as a mass spectrum on a display portion 7 such as a liquid-crystal display screen.

In order to select desired precursor ion peaks, the CPU 6 sends signals to the ion source 1 and to the ion gate (not shown) to control the timing of the ionization effected by laser light emitted from the ion source 1, the timing of application of an accelerating voltage, and the timing at which the ion gate (not shown) placed in the first TOF mass analyzer 2 is turned on and off, based on the contents of instructions given from a human operator. Consequently, the first mass analyzer can select only the desired precursor ion peak such that the precursor ions are introduced into the fragmentation means 3.

The flight time T1 through the first TOF mass analyzer used in the present embodiment (i.e., fight time taken for ions to travel from the ion source to the gate) is set about 3 times to 10 times greater than the flight time T2 through the second TOF mass analyzer (i.e., flight time taken for ions to travel from the gate to the second detector). One example of the first TOF mass analyzer that satisfies this requirement is a helical-orbit TOF mass spectrometer having an ion orbit formed by plural electric sector fields. Another example is a zigzagged-orbit TOF mass spectrometer having an ion orbit formed by plural reflectron electric fields. An ion source having good compatibility in being coupled to the TOF/TOF instrument of the present embodiment is an ion source using a laser ionization method typified by matrix-assisted laser desorption/ionization (MALDI). In a MALDI process, monovalent ions are principally generated.

Generally, a collisional cell has an entrance/exit made of a cell having a diameter on the order of millimeters. Therefore, some of the precursor ion beam may be blocked by the entrance/exit. Consequently, a mass spectrometry detector may be placed immediately behind the first TOF mass analyzer to secure sufficient sensitivity for mass spectrometry measurements.

One method for this is to place a mass spectrometry detector between the first TOF mass analyzer and the collisional cell, the detector being capable of moving into and out of the ion orbit. Another method is to place a means for switching the orbit such as an electric sector field or deflector in the ion orbit. When an MS measurement is performed, the incident direction of the ion beam is switched such that the beam is directed to the mass spectrometry detector. When an MS/MS measurement is made, the direction of the ion beam is switched such that the beam is directed to the collisional cell.

In the first TOF mass analyzer, sample compounds are ionized by the ion source being a component of the mass analyzer, and the generated ions are accelerated by applying a pulsed voltage to the ions. The sample compounds are turned into sample ions by the ionization. First, in order to measure mass spectra, all the ions are passed through the ion gate without eliminating them by the gate. The ions are passed into the detector in the second TOF mass analyzer via the collisional cell and via the second TOF mass analyzer. Thus, a mass spectrum of the ions is generated.

Figures 7A, 7B:
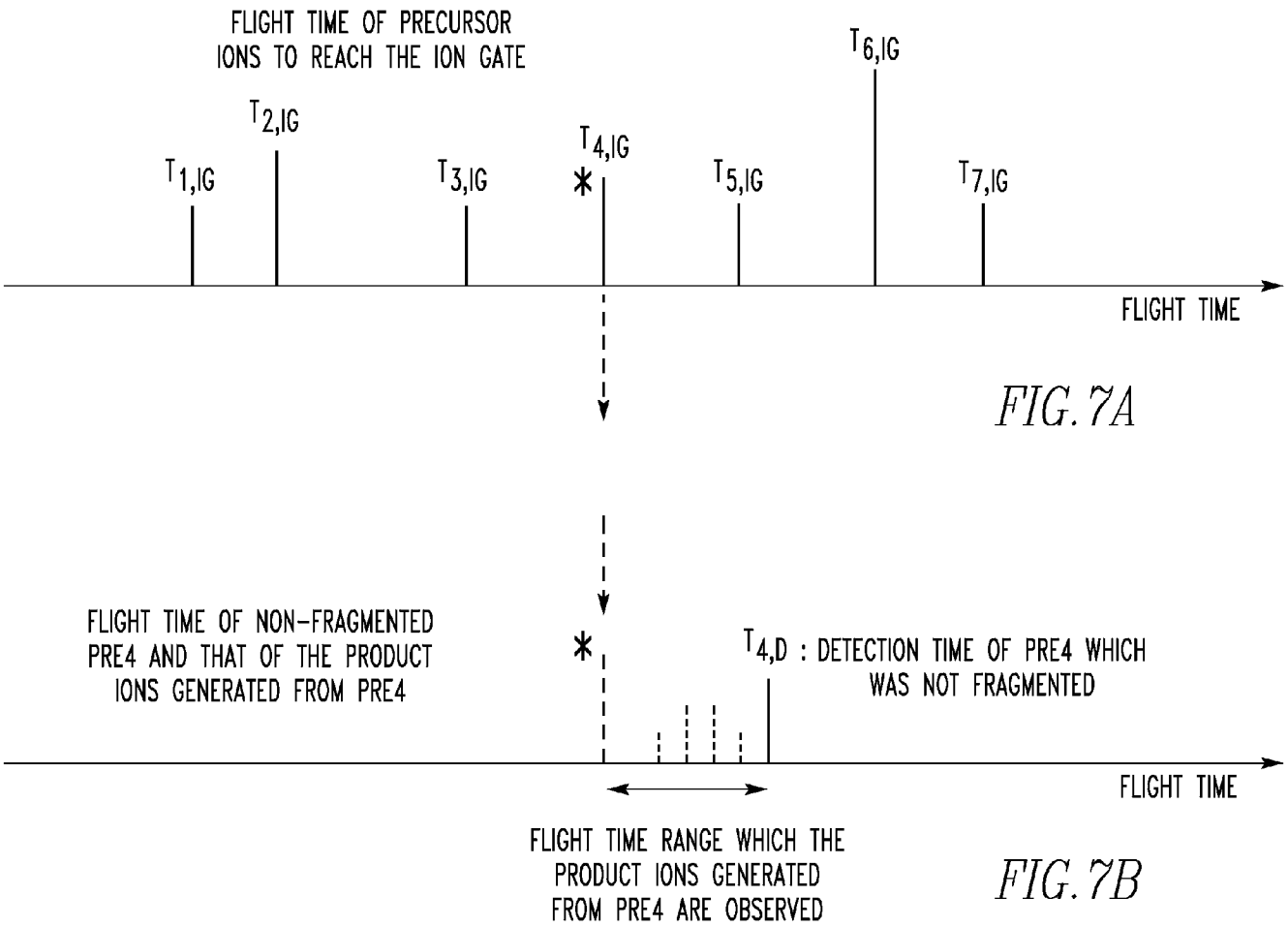
FIGS. 7A and 7B are diagrams illustrating relationships between precursor ions and product ions.

MS/MS measurements are next described by referring to FIGS. 7A and 7B. In this case, precursor ion Pre4 is selected from seven precursor ions Pre1 to Pre7 (all of which are monovalent; it is assumed that a precursor ion having a smaller number has a smaller mass). The ions are mass separated by the first TOF mass analyzer and then reach the ion gate.

Let $T_{X,1G}$ be the time taken for each precursor ion PreN to reach the ion gate. As shown in FIG. 7A, the ions reach the ion gate first from the ions having the minimum mass. The precursor ion Pre4 is selected by the ion gate and then is partially fragmented in the collisional cell, thus producing product ions. The generated product ions and the surviving precursor ions are mass separated in the second TOF mass analyzer and detected by the detector.

At this time, the precursor ions show the longest flight time and so the time from the instant when selection is made by the ion gate to the instant when the precursor ions are detected by the detector is the flight time range of Pre4 for MS/MS measurements.

Figure 8A:
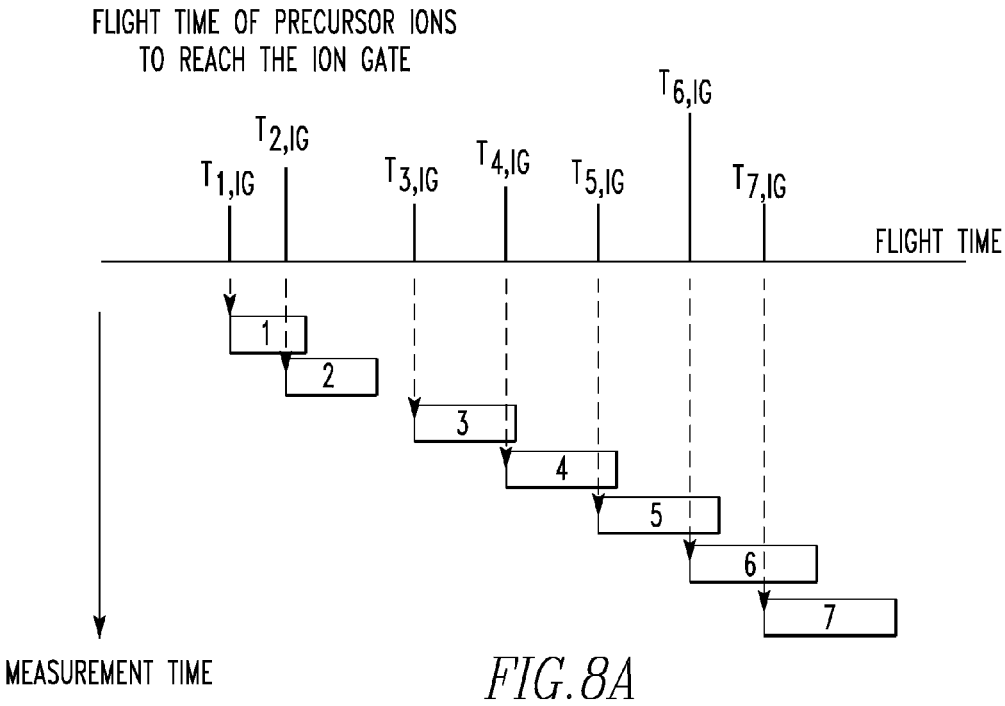
FIGS. 8A and 8B illustrate examples of method of tandem mass spectrometry associated with the present invention.
Figure 8B:
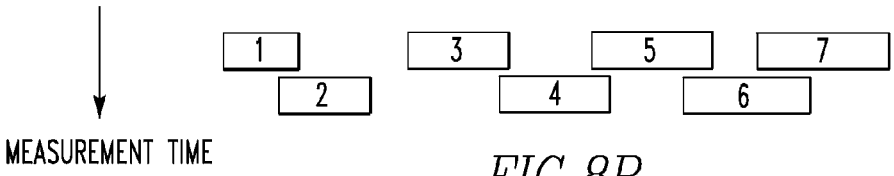

A case in which the precursor ions are successively measured from Pre1 to Pre7 and a method of switching the measured precursor ion in a stepwise manner are now described. In the diagrams of FIGS. 8A and 8B, the flight time ranges of the precursor ions are plotted on the horizontal axis. The times taken to measure the precursor ions are plotted on the vertical axis. The time taken to measure each ion is represented by the number of repetitions of a unit measurement time. Each precursor ion has a rectangular region defined by a flight time range and a measurement time. These rectangular regions should not overlap each other.

That is, an array input means is provided such that the flight time ranges required for the selected precursor ions and measurement times actually taken to measure the precursor ions are suitably arranged in a time-sequential manner while preventing the flight time ranges and the measurement times from overlapping each other. The array of the measurement times can be adjusted.

This time-sequential array may be determined by a skilled operator based on his experience. Alternatively, mass spectra may be collected by preliminary measurements. The m/z values of the ion peaks in these mass spectra may be found. The precursor ions as exemplified in the table of FIG. 6 may be fragmented and a measurement may be made using the second TOF mass analyzer 4. The time taken from this measurement until a measurement of a next precursor ion is performed is measured. The found m/z values, the masses of the precursor ions, and the measured time may be listed in a table, and comparisons of these numerical values may be made by the CPU. Thus, an optimum time-sequential array may be determined automatically. Then, nontrial measurements may be made.

This object is achieved by a tandem TOF mass spectrometer according to the present invention, the spectrometer having a gate signal generator for generating a gate signal to open the ion gate such that a desired ion species passes through it. The gate signal generator may have a schedule creation means for creating a schedule of timings at which the gate signal for selectively passing precursor ions appearing in a mass spectrum is generated when the ions are selectively passed through the ion gate such that product flight time ranges in which product ions are detected by a second detector do not overlap each other based on mass spectral data about the precursor ions previously obtained using the first detector.

In this example, since the flight times through the first TOF mass analyzer are not sufficiently long, it is impossible to measure all the precursor ions Pre1 to Pre7 at the same time by MS/MS technology. FIG. 8A illustrates a case in which the precursor ions are selected in turn. FIG. 8B illustrates a case in which a first step in which Pre1, Pre3, Pre5, and Pre7 are selected is followed by a second step in which Pre2, Pre4, and Pre6 are selected. That is, the process consists of the two steps.

Comparison between the measurement times of FIGS. 8A and 8B shows that MS/MS measurements can be performed in shorter times and more efficiently in the example of FIG. 8B than in the example of FIG. 8A. A mass spectrum of high quality can be efficiently obtained in a short time with reduced sample wastage by performing these two steps alternately and repeatedly so as to accumulate measurement data.

In brief, to prevent the flight time ranges required by the individual precursor ions and measurement times actually taken to measure the precursor ions from overlapping each other, measurements of the precursor ions are reorganized into plural stages of measurements in the present embodiment. In each stage of measurement, only precursor ions capable of being measured without being overlapped are measured. The measurement is made to proceed while switching the measurement stage in turn. This is the essence of the present embodiment.

Accordingly, in the case of FIG. 8B, only two stages of measurement are provided. It is obvious, however, that three or more stages of measurement may be provided.

Embodiment 2

A tandem TOF mass spectrometer according to the present embodiment is exactly identical in fundamental structure with the instrument shown in FIG. 4 and so its description is omitted here.

In Embodiment 1, individual precursor ions are measured in the same measurement time. Generally, however, the amount of precursor ions is different for each ion species at the instant of ionization. Therefore, for a precursor ion species having a small amount of ions, it is necessary that the measurement time be increased and the number of accumulations be increased to secure a sufficient amount of product ions, thus improving the quality of the obtained information.

In the present embodiment, it is assumed that ions of Pre4 and Pre7 need longer measurement times than the other ions. Where Pre1, Pre3, Pre5, and Pre7 are first selected and measured, if the measurement end time is adjusted to Pre7 that needs a long measurement time, then it follows that measurements which will result in over-quality are performed on the three ion species Pre1, Pre3, and Pre5.

Figure 9:
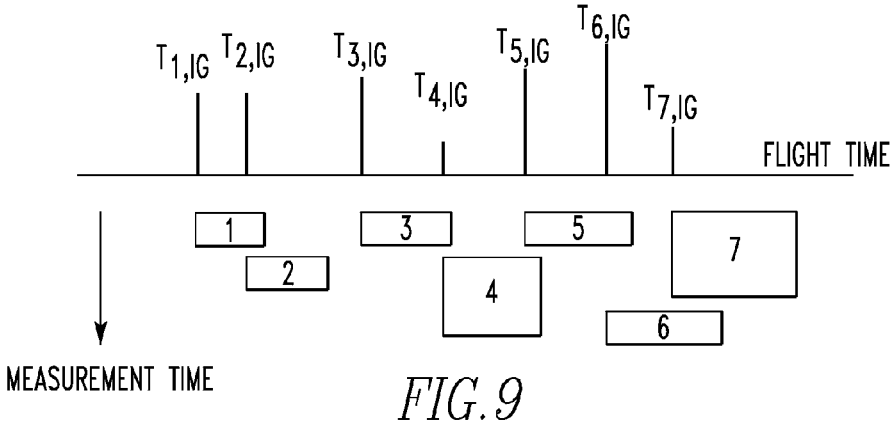
FIG. 9 illustrates another example of method of tandem mass spectrometry associated with the present invention.

Accordingly, in the present embodiment, as shown in FIG. 9, measurements are performed in measurement times required only for Pre1, Pre3, and Pre5. Then, one measurement of Pre7 is performed. Then, Pre2 and Pre4, which do not temporally interfere with Pre7, are measured. Then, Pre7 is again measured to improve the quality of data about Pre7.

After the end of the second measurement of Pre7, measurement of Pre4 and Pre6, which do not temporally interfere with Pre7, is started. Since Pre4 is measured for the second time, the quality of data about Pre4 can be improved.

In brief, in the present embodiment, the array of measurement times can be readjusted such that precursor ions having small amounts of ions can be measured over plural stages of measurement as described above.

In this way, MS/MS measurements can be performed efficiently without wasting the sample by ingeniously combining flight time ranges required for individual precursor ions with measurement times actually taken to measure the precursor ions.

The present invention can be widely applied to MS/MS measurements implemented by a tandem time-of-flight mass spectrometer.

Having thus described my invention with the detail and particularity required by the Patent Laws, what is desired protected by Letters Patent is set forth in the following claims.

The invention claimed is:

1. A tandem time-of-flight mass spectrometer comprising:

an ion source for ionizing a sample and ejecting the produced ions in a pulsed manner and repetitively;

a first TOF mass analyzer for causing the ejected sample ions to travel and for mass analyzing the ions;

a first detector for detecting precursor ions separated according to mass-to-charge ratio in the first TOF mass analyzer;

an ion gate disposed in a path through which the precursor ions separated according to mass-to-charge ratio by the first TOF mass analyzer travel;

a collisional cell into which the precursor ions passed through the ion gate are introduced for fragmenting the ions to thereby produce product ions;

a second TOF mass analyzer for causing the product ions emerging from the collisional cell to travel and for separating the ions according to mass-to-charge ratio;

a second detector for detecting the ions separated by the second TOF mass analyzer; and a gate signal generator for generating a gate signal to open the ion gate after a delay since ejection of sample ions from the ion source such that desired ion species pass through the gate;

wherein said given flight time T1 through the first TOF mass analyzer is set twice or more greater than the given flight time T2 through the second TOF mass analyzer;

wherein said gate signal generator has schedule creation means for creating a schedule of timings at which the gate signal for selectively passing the precursor ions through the ion gate is generated such that when the precursor ions appearing in a mass spectrum based on mass spectral data about precursor ions previously obtained using the first detector are selectively passed through the ion gate, flight time ranges in which the product ions are detected by the second detector do not overlap each other;

wherein said gate signal generator generates the gate signal based on the schedule created by the schedule creation means and supplies the generated gate signal to the ion gate; and wherein said schedule creation means creates the schedule of timings at which the gate signal is generated for plural mass analyses to permit the second TOF mass analyzer to mass analyze product ions regarding all the precursor ions owing to plural mass analyses made by the first TOF mass analyzer in a case where the second TOF mass analyzer cannot mass analyze product ions regarding all the precursor ions appearing in the mass spectrum of precursor ions while a single mass analysis is being made by the first TOF mass analyzer.

2. The tandem time-of-flight mass spectrometer as set forth in claim 1, wherein said flight time T1 is set 3 times to 10 times greater than the flight time T2.

3. A tandem time-of-flight mass spectrometer comprising:

an ion source for ionizing a sample and ejecting the produced ions in a pulsed manner and repetitively;

a first TOF mass analyzer for causing the ejected sample ions to travel and for mass analyzing the ions;

a first detector for detecting precursor ions separated according to mass-to-charge ratio in the first TOF mass analyzer;

an ion gate disposed in a path through which the precursor ions separated according to mass-to-charge ratio by the first TOF mass analyzer travel;

a collisional cell into which the precursor ions passed through the ion gate are introduced for fragmenting the ions to thereby produce product ions;

a second TOF mass analyzer for causing the product ions emerging from the collisional cell to travel and for separating the ions according to mass-to-charge ratio;

a second detector for detecting the ions separated by the second TOF mass analyzer; and a gate signal generator for generating a gate signal to open the ion gate after a delay since ejection of sample ions from the ion source such that desired ion species pass through the gate;

wherein said given flight time T1 through the first TOF mass analyzer is set twice or more greater than the given flight time T2 through the second TOF mass analyzer;

wherein said gate signal generator has schedule creation means for creating a schedule of timings at which the gate signal for selectively passing the precursor ions through the ion gate is generated such that when the precursor ions appearing in a mass spectrum based on mass spectral data about precursor ions previously obtained using the first detector are selectively passed through the ion gate, flight time ranges in which the product ions are detected by the second detector do not overlap each other;

wherein said gate signal generator generates the gate signal based on the schedule created by the schedule creation means and supplies the generated gate signal to the ion gate; and wherein said gate signal generator holds information indicating a relationship between mass-to-charge ratios of the precursor ions selected by the ion gate and mass-to-charge ratios of precursor ions capable of being selected next, and wherein regarding precursor ions appearing in a precursor ion mass spectrum based on the information, the schedule creation means creates the schedule of timings at which the gate signal is generated to selectively pass the precursor ions such that flight time ranges in which the product ions are detected by the second detector do not overlap each other when the precursor ions are selectively passed through the ion gate.

4. The tandem time-of-flight mass spectrometer as set forth in claim 3, wherein said flight time T1 is set 3 times to 10 times greater than the flight time T2.

* * * * *